US008801267B2

(12) United States Patent
Gentgen

(10) Patent No.: US 8,801,267 B2
(45) Date of Patent: Aug. 12, 2014

(54) STATIC MIXER FOR AN EXHAUST GAS SYSTEM OF AN INTERNAL COMBUSTION ENGINE

(75) Inventor: Holger Gentgen, Wagenhoff (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 870 days.

(21) Appl. No.: 12/931,140

(22) Filed: Jan. 25, 2011

(65) Prior Publication Data

US 2011/0205837 A1 Aug. 25, 2011

(30) Foreign Application Priority Data

Feb. 23, 2010 (DE) ..... 10 2010 009 043

(51) Int. Cl.
*B01F 5/06* (2006.01)

(52) U.S. Cl.
USPC ..... 366/337; 60/324

(58) Field of Classification Search
CPC .. B01F 5/0616; F01N 3/2892; F01N 2240/20
USPC ..... 366/181.5, 336–340; 60/317, 324
See application file for complete search history.

(56) References Cited

U.S. PATENT DOCUMENTS

| | | | | |
|---|---|---|---|---|
| 4,848,920 | A | 7/1989 | Heathe et al. | |
| 7,805,932 | B2 | 10/2010 | Oxborrow | |
| 8,141,353 | B2 * | 3/2012 | Zheng et al. | 60/324 |
| 2009/0266064 | A1 * | 10/2009 | Zheng et al. | 60/317 |
| 2011/0205837 | A1 * | 8/2011 | Gentgen | 366/337 |
| 2012/0320708 | A1 * | 12/2012 | Geibel | 366/337 |
| 2013/0170973 | A1 * | 7/2013 | Staskowiak et al. | 415/208.1 |
| 2014/0069087 | A1 * | 3/2014 | Vanvolsem et al. | 60/319 |

FOREIGN PATENT DOCUMENTS

| | | | | |
|---|---|---|---|---|
| DE | 100 60 808 | | 7/2002 | |
| DE | 10 2006 058 715 | | 1/2008 | |
| DE | 10 2007 040 360 | | 4/2008 | |
| DE | 10 2007 012 790 | | 9/2008 | |
| DE | 102007012790 | A1 * | 9/2008 | F01N 3/28 |
| DE | 10 2008 017 395 | | 10/2009 | |
| DE | 10 2008 029 110 | | 12/2009 | |
| DE | 102008029110 | A1 * | 12/2009 | F01N 3/28 |
| EP | 2388063 | A1 * | 11/2011 | |
| WO | WO 2013026782 | A2 * | 2/2013 | |
| WO | WO 2013/087850 | A1 * | 6/2013 | |

OTHER PUBLICATIONS

Paper entitled, "Attachment for the Information Disclosure Statement" discussing some of the prior art refrences, Jan. 25, 2011.

* cited by examiner

*Primary Examiner* — Charles Cooley
(74) *Attorney, Agent, or Firm* — Collard & Roe, P.C.

(57) ABSTRACT

A static mixer for an exhaust gas system of an internal combustion engine with which at least two different fluid streams are mixed almost homogeneously after a short mixing distance, and with which back-flow effects and pressure losses are avoided, to the greatest possible extent. Due to the placement of flow guide devices, the inclined front sections of which are disposed alternately facing in different directions, and by the configuration and placement of the fluid passage spaces, which are delimited by guide elements, intensive and homogeneous mixing of two different fluid streams is achieved, while avoiding turbulent flows and pressure losses. Mixing of the fluid streams is supported by guide vanes that are disposed on the flow guide elements in the front region of the central center element, and on a frame that delimits the inclined sections of the flow guide elements.

10 Claims, 3 Drawing Sheets

STATIC MIXER FOR AN EXHAUST GAS SYSTEM OF AN INTERNAL COMBUSTION ENGINE

CROSS REFERENCE TO RELATED APPLICATIONS

Applicant claims priority under 35 U.S.C. 119 of German Application No. 10 2010 009 043.3 filed on Feb. 23, 2010.

BACKGROUND OF THE INVENTION

1. Field of the Invention

The invention relates to a static mixer for an exhaust gas system of an internal combustion engine which is disposed in an exhaust gas pipe of the internal combustion engine and which consists of a plurality of flow guide elements that influence the flow of a fluid stream. The flow guide elements are disposed on a central center element and extend outwardly in the direction of the inner wall of the exhaust gas pipe. The flow guide elements have a section in the flow direction of the fluid stream that is inclined at a predetermined angle relative to the flow guide elements.

2. The Prior Art

It is known that the reduction of nitrogen oxide emissions of the exhaust gases of an internal combustion engine takes place by means of selective catalytic reduction (SCR). In this connection, a suitable reduction agent, such as liquid urea or gaseous ammonia, is introduced into the exhaust gas stream in the case of a lean exhaust gas composition, for the purpose of $NO_x$ reduction. Usually, a static mixer is used to mix the reduction agent with the exhaust gas, by means of which mixer a desired distribution of the reduction agent in the exhaust gas stream is supposed to be achieved, for the purpose of efficient exhaust gas purification.

German Patent No. DE 10 2007 012 790 B4 describes a static mixer for mixing a reduction agent with the exhaust gas stream of an internal combustion engine, which mixer is disposed in the exhaust gas pipe of the internal combustion engine, and consists of a plurality of flow guide elements that influence the flow of a fluid stream, configured in the manner of vanes. The flow guide elements are disposed on a central center element and extend in the direction of the inner wall of the exhaust gas pipe. The flow guide elements consist of a carrier element on which vane-like sections are disposed, to influence the flow. In this connection, the vane-like sections are disposed on the carrier element in such a manner that they have a predetermined angle relative to the flow direction of the exhaust gas stream.

German Patent Application No. DE 100 60 808 A1 describes a mixing device which consists of multiple guide blades. The guide blades are disposed in the exhaust gas pipe, on a central center element. The flow direction is deflected as the exhaust gas flows through the mixing device by the guide blades configured in the manner of blades.

U.S. Pat. No. 4,848,920 describes a static mixer which is supposed to produce a homogeneous media stream. This mixer has a number of ribs disposed around a central hub, spaced apart from one another at angles. Additional vane elements are formed onto these ribs.

German Patent Application No. DE 10 2008 017 395 A1 describes a mixer that is produced from only a single sheet-metal body. The mixer consists of a pipe body having radially projecting blades on the axial ends. The blades are disposed and configured in such a manner that they are set at an angle relative to an axial direction of the pipe body. As a result, the flow resistance is increased in the region of the blades, and swirling is produced. This swirling of the exhaust gas stream supports the evaporation of the liquid reduction agent, if applicable, and improves the homogenization of the mixture.

German Patent No. DE 10 2006 058 715 B3 describes a static mixer for an exhaust gas system of an internal combustion engine, which mixer consists of a plurality of flow elements that influence the flow of the exhaust gas stream. The flow guide elements are formed by single-vane guide vanes that project away from a mixer plane in the flow direction of the exhaust gas. The vanes are disposed in multiple guide vane rings about a mixer center point, and are inclined away from the mixer center point, proceeding from their connection point to the mixer radially to the outside, so that the exhaust gas stream is forced radially outward by the guide vanes.

The mixers used serve primarily to mix liquid reduction agents with the exhaust gas stream. In addition, the liquid reduction agent is supposed to be evaporated when it impacts the components of the mixer. When gaseous reduction agents are used, sufficient mixing of the gaseous reduction agent with the exhaust gas stream is not possible with the mixers described. Another disadvantage of the mixers is that turbulent flows occur as the result of the flow guide elements or the blades, and these can lead to undesirable back-flow effects. Furthermore, the back-flow effects have a negative impact on the pressure loss above the mixer.

SUMMARY OF THE INVENTION

It is therefore an object of the invention to create a static mixer for an exhaust gas system of an internal combustion engine, with which at least two different fluid streams are mixed almost homogeneously after a short mixing distance, and with which back-flow effects are avoided, to the greatest possible extent, and the pressure loss over the mixer is restricted to a minimum.

According to the invention, this task is accomplished by a mixer in which the angle sections on the flow guide elements are disposed alternately facing in different directions, in such a manner that the free flow cross-section between two adjacent flow guide elements is reduced, and the free flow cross-section between two different adjacent flow guide elements is maintained. There is a frame element disposed on the front of the section of the flow guide elements, viewed opposite the direction of the fluid stream. There are guide elements facing in the direction of the central center element and connected with the center element and disposed on the frame elements, in such a manner that a free fluid passage space is formed after two guide elements which are connected with their longitudinal sides that face in the direction of the center element.

Due to the placement of flow guide devices, the inclined front sections of which are disposed alternately facing in different directions, and by means of the configuration and placement of the fluid passage spaces, which are delimited by guide elements, intensive and homogeneous mixing of two different fluid streams is achieved, while avoiding turbulent flows and pressure losses. Mixing of the fluid streams is supported by guide vanes that are disposed on the flow guide elements in the front region of the central center element, and on a frame that delimits the inclined sections of the flow guide elements.

Another advantage of the mixer according to the invention consists in its relatively simple structure, because the main components are formed by correspondingly bent metal sheets and are connected with one another in terms of material.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
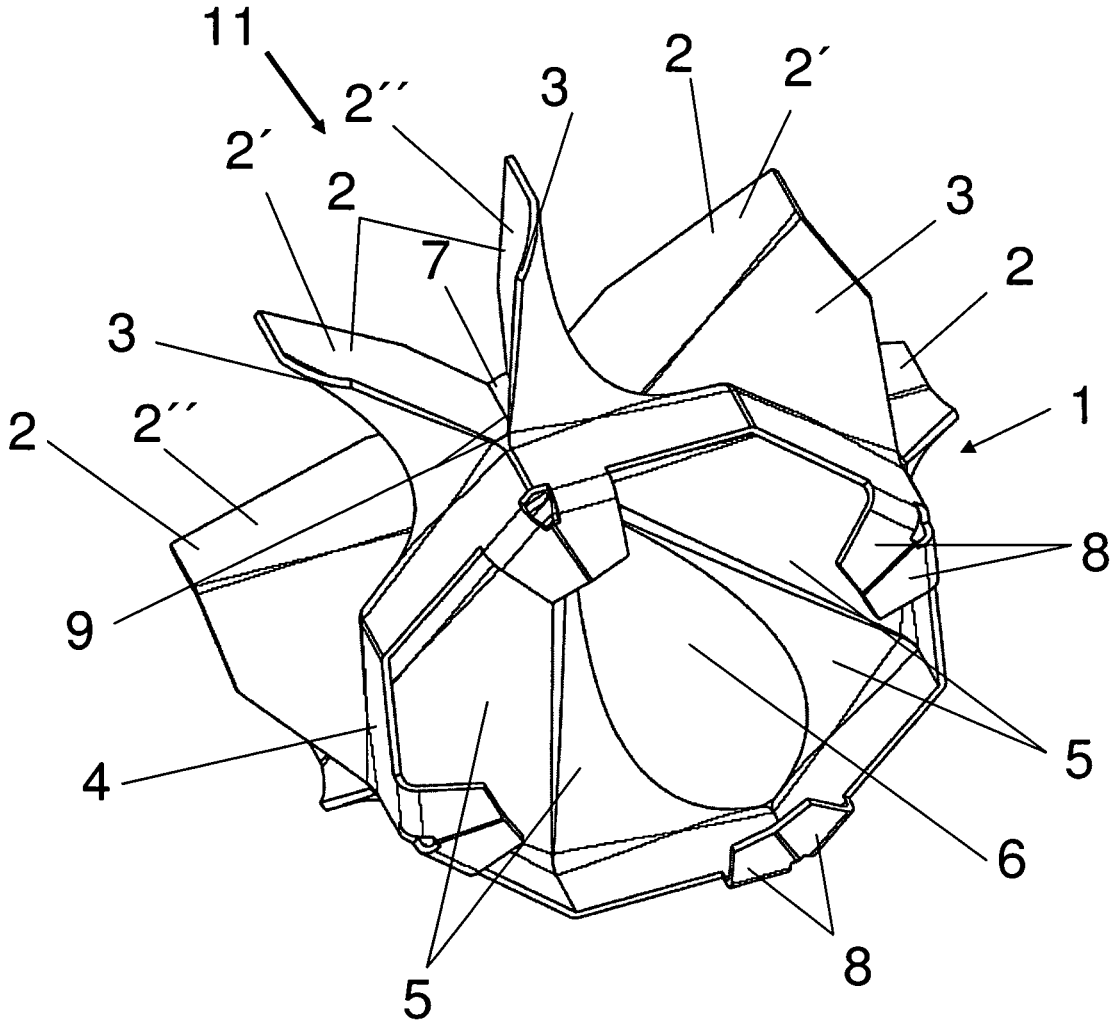
FIG. 1 shows a schematic representation of the mixer according to one embodiment of the invention, in a perspective view.

Referring now in detail to the drawings, a mixer 1 according to the invention, for mixing the exhaust gases of an internal combustion engine with a reduction agent that is supplied to the exhaust gas stream, is shown in FIG. 1, in perspective. In this connection, the reduction agent is preferably a gaseous substance, such as gaseous ammonia, for example. It is also possible to mix a liquid reduction agent with the exhaust gas stream using mixer 1 according to the invention. In the following, the exhaust gas stream and the supplied reduction agent are referred to as a fluid stream. The flow direction 11 of the fluid flow is indicated with a corresponding arrow in the drawings. Mixer 1 is disposed in an exhaust gas pipe, not shown, of an internal combustion engine, in known manner.

Mixer 1 consists of a plurality of flow guide elements 2 that influence the fluid stream, which elements are axially disposed around a central center element 7 and extend in the direction of the inner wall of the exhaust gas pipe. Flow guide elements 2 are preferably disposed around central center element 7 at uniform intervals. In the embodiment shown, the number of flow guide elements 2 amounts to a total of eight pieces. The number of flow guide elements 2 can be selected to be greater or less, in accordance with the conditions, whereby an even number of flow guide elements 2 must always be used.

Figure 2:
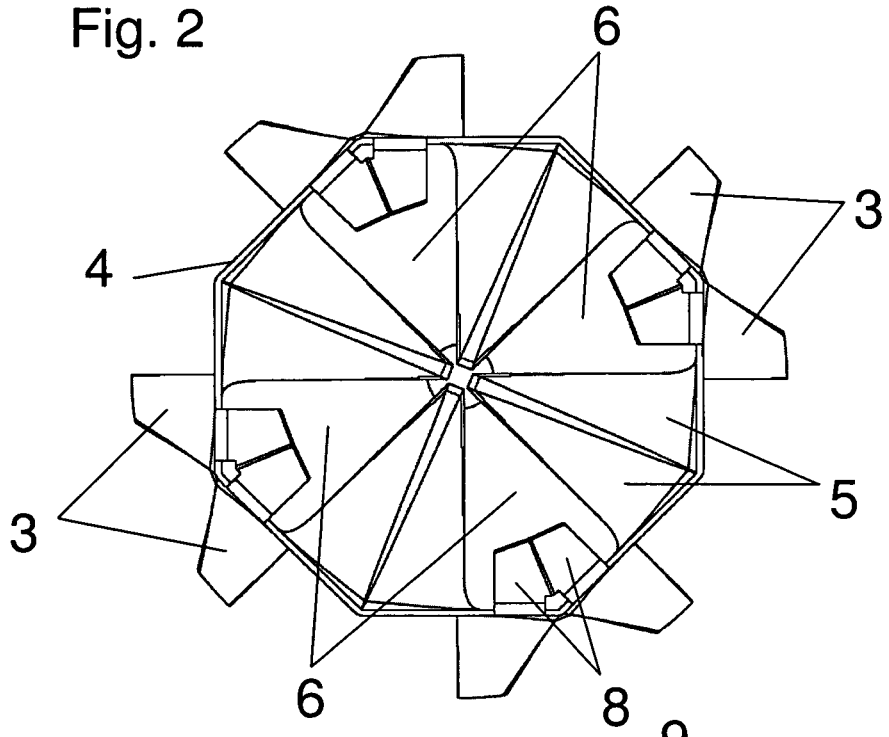
FIG. 2 shows a front view of the mixer according to FIG. 1, seen opposite the direction of fluid flow.

Flow guide elements 2 have a section 3 that is angled away relative to the longitudinal axis of flow guide elements 2, in the rear region, seen in flow direction 11 of the fluid stream. In this connection, angled sections 3 are disposed on flow guide elements 2, alternately facing in different directions. Preferably, angled sections 3 are configured to be bent in the manner of blades, whereby the insides of two blade-like sections 3 are disposed to face one another. In FIG. 1, a pair of adjacent flow guide devices 2 are designated with 2' and 2", for a better representation. By means of sections 3 that alternately face in different directions, a region is formed between the two adjacent flow guide elements 2' and 2", in which region the inclined or angled sections 3 face one another and in which front lower edges 9 of sections 3 that face one another almost touch. Due to this arrangement, the free flow cross-section between the two adjacent flow guide elements 2' and 2" is reduced. Furthermore, a region is formed between the adjacent flow guide elements 2" and 2', in which region the free flow cross-section is not influenced by sections 3 and is therefore maintained. In FIG. 2, the placement of sections 3 and the formation of the free flow cross-sections can be seen.

By means of sections 3, which are angled away or bent in the manner of blades, and alternately face in different directions, the flow direction 11 and the flow velocity of the fluid stream are changed, so that as a result, the mixing effect in the fluid stream is improved, and homogeneous mixing of the fluid stream takes place.

A frame element 4 is disposed on lower edge 9 of inclined sections 3 of flow guide elements 2 which elements form a closed frame due to being connected with one another in terms of material. In this connection, a frame having a number of corners in accordance with the number of flow guide elements 2 is formed. Frame elements 4 can be formed by bending the side wall of sections 3 of flow guide elements 2, which sections are bent in the manner of blades or angled away. However, frame elements 4 can also be produced as a separate component, which components are then connected with corresponding sections 3 by welding, soldering, or the like. Guide elements 5, which face in the direction of central center element 7 and are connected with it, are disposed on frame elements 4.

Guide elements 5 that face in the direction of the central center element 7 and are connected with center element 7 are disposed on frame elements 4. In this connection, two guide elements 5 disposed next to one another are connected with their longitudinal sides, which face in the direction of the center element 7. Furthermore, the guide elements 5 are configured in such a manner that a free fluid passage space 6 is formed after two guide elements 5 are connected with their facing longitudinal sides. The free fluid passage space 6 is disposed so that it lies in the region below adjacent flow guide elements 2' and 2", in which region the sections 3 are disposed to face one another, so that—as is evident from FIG. 2—four free fluid passage spaces 6 are formed, distributed over the circumference of mixer 1. Guide elements 5 are configured so that free fluid passage space 6 constantly widens in flow direction 11 of the fluid stream and in the direction of the inner wall of the exhaust gas pipe.

Figure 3:
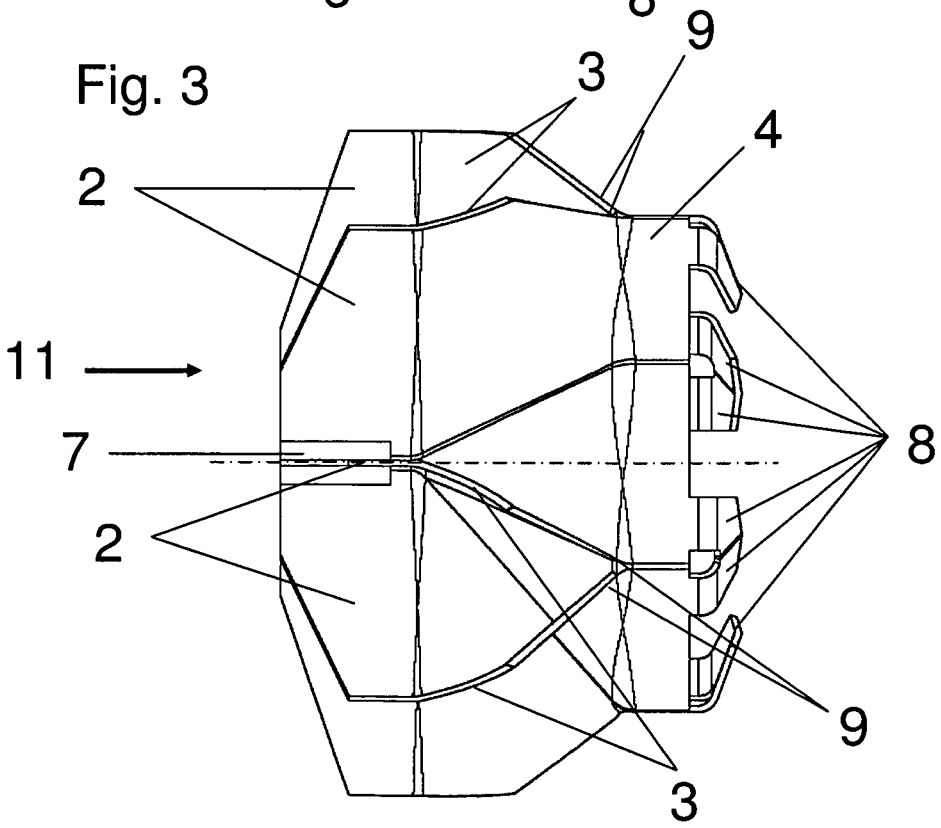
FIG. 3 shows a side view of the mixer according to FIG. 1.

As is evident from FIG. 3, central center element 7, on which flow guide elements 2 are firmly disposed, extends in the axial direction only over a partial region of mixer 1. The lower edge of each flow guide element 2 is configured in such a manner that it assumes a constantly greater distance from the center axis after central center element 7, in the axial direction, so that a space that widens is formed in the interior of mixer 1, in connection with guide elements 5.

A guide vane 8 is disposed on each of frame elements 4, which vane faces in the direction of the center axis of mixer 1 at a predetermined angle, which is variably adjustable in accordance with the desired flow conditions. The configuration of guide vanes 8 with regard to their size and shape is also dependent on the mixing effects to be achieved. Guide vanes 8 are disposed in such a manner that they cover a partial region of free fluid passage space 6 and thus influence the fluid flow.

Figure 4:
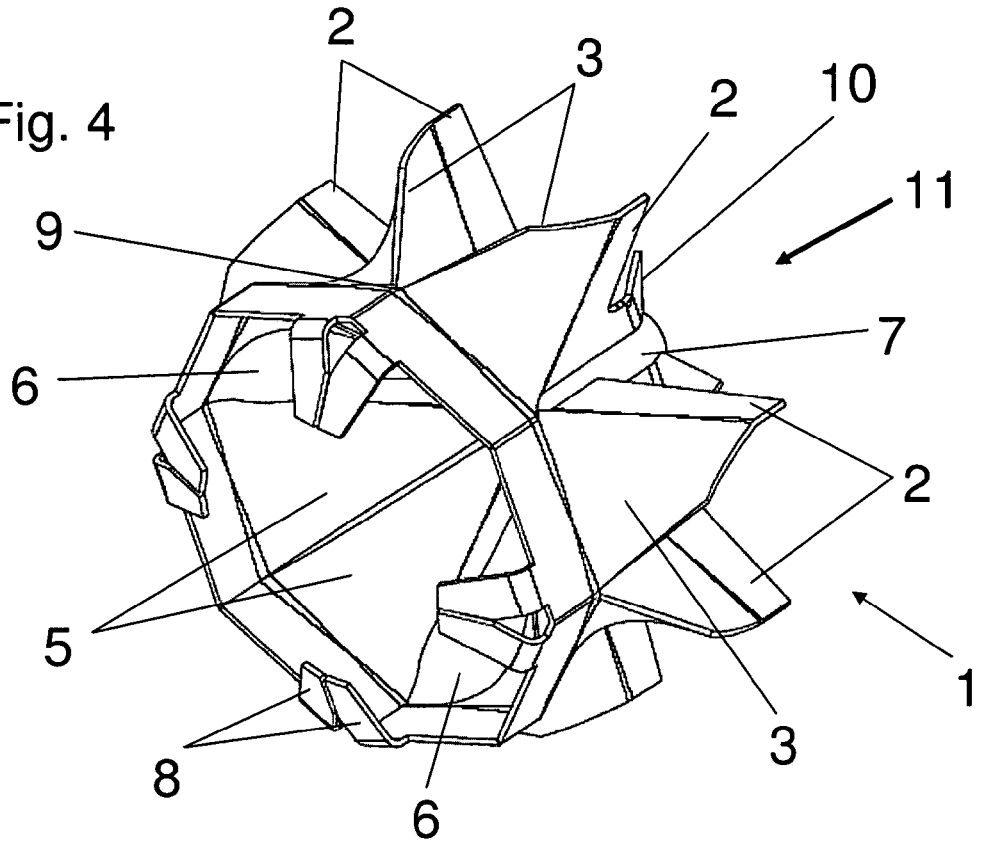
FIG. 4 shows an alternative embodiment of the mixer according to the invention, in a perspective representation.
Figure 5:
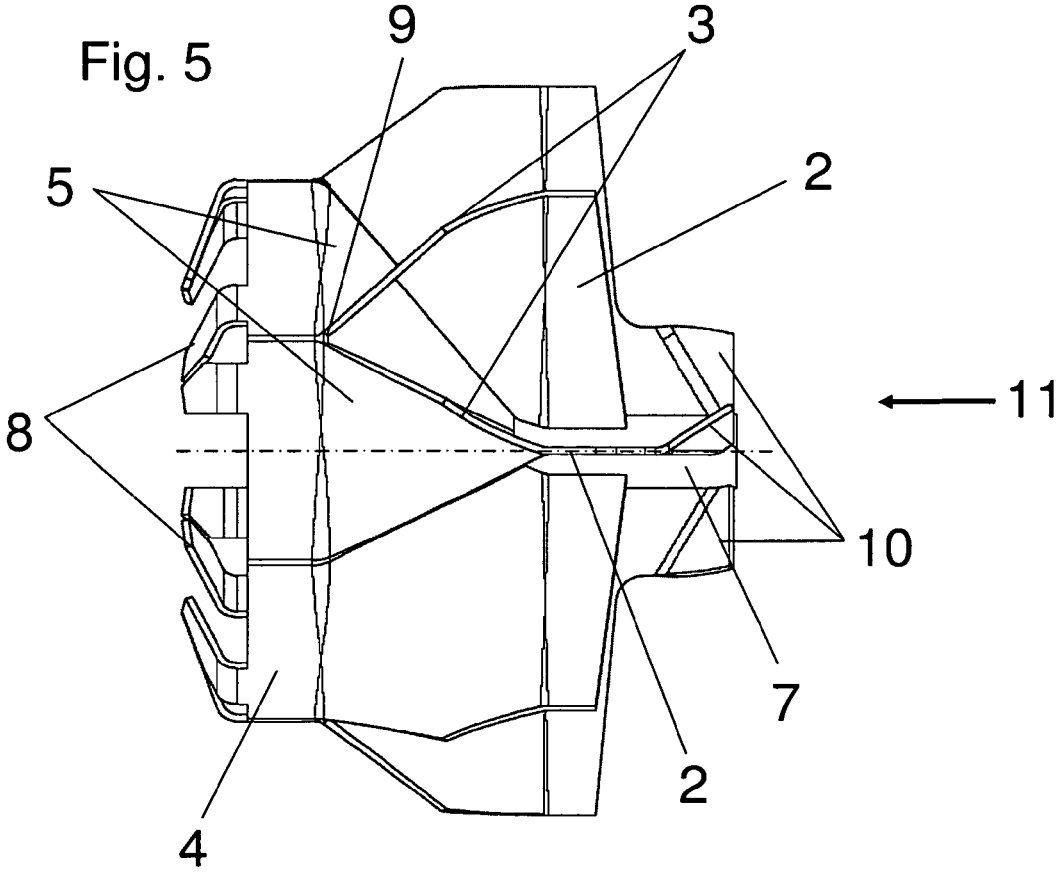
FIG. 5 shows a side view according to FIG. 4.

In FIGS. 4 and 5, a variant of mixer 1 according to the invention is shown. In this connection, flow guide elements 2 are additionally provided with an inclined guide vane 10 in the front region of central center element 7. Due to guide vanes 10, the fluid stream is passed to mixer 1 already having been influenced in its flow direction 11.

Due to the placement of angled sections 3 on flow guide elements 2, the placement of guide elements 5, forming free fluid passage spaces 6, the placement of guide vanes 8 in the region of fluid passage spaces 6, and the placement of guide vanes 10 on flow guide elements 2, an intensive influence on the fluid flow is achieved, so that after a short mixing distance, almost homogeneous mixing of the fluid flow takes place, and back-flow effects and pressure losses are generally avoided. Mixer 1 according to the invention is particularly suitable for intensive mixing of two different gaseous fluid streams, such as, for example, gaseous ammonia into an exhaust gas stream of an internal combustion engine.

Another significant advantage is that a segment of mixer 1, consisting of a flow guide element 2, an angled section 3, a frame element 4, a guide vane 8 and guide element 5, preferably consists of a component that has been bent in multiple ways, and the individual segments are combined to form mixer 1 by being joined by material, such as by welding or soldering or the like. In this way, it is possible to further reduce the production effort. However, it is also possible to produce the individual parts separately and then to join them with one another by material joining.

Accordingly, while only a few embodiments of the present invention have been shown and described, it is obvious that many changes and modifications may be made thereunto without departing from the spirit and scope of the invention.

LIST OF REFERENCE SYMBOLS USED

1 mixer
2 flow guide element
2' flow guide element
2" flow guide element
3 section
4 frame element
5 guide element
6 fluid passage space
7 central center element
8 guide vane
9 lower edge of section 3, in each instance
10 guide vane
11 flow direction of the fluid stream

What is claimed is:

1. A static mixer for an exhaust gas system of an internal combustion engine which is adapted to be disposed in an exhaust gas pipe of the internal combustion engine, comprising:

a center element;

a plurality of flow guide elements that influence the flow of a fluid stream when said mixer is placed in the fluid stream, said flow guide elements being disposed on the center element extending outwardly from the center element, each of said flow guide elements having a section that when viewed in a flow direction of the fluid stream is disposed inclined at a predetermined angle relative to a longitudinal axis of the flow guide elements, and each of said sections being disposed alternately facing in different directions so that a free flow cross-section between two adjacent flow guide elements having sections that face each other is reduced, and the free flow cross-section between two adjacent flow guide elements having sections that face away from each other is maintained;

a frame element disposed on a front of each of the sections, when viewed opposite the flow direction of the fluid stream; and guide elements facing toward the center element and connected with the center element, said guide elements being disposed on the frame elements so that a free fluid passage space is formed by two of said guide elements that are connected with their longitudinal sides and that face in the direction of the center element.

2. The static mixer according to claim 1, wherein the angled sections are formed bent from the flow guide elements.

3. The static mixer according to claim 1, wherein each free fluid passage space is disposed in a region below the sections of the flow guide elements that face one another, and delimited by the guide elements, so that each free fluid passage space constantly widens in the flow direction of the fluid stream and radially outwardly from a longitudinal axis of the mixer.

4. The static mixer according to claim 1, wherein the frame elements form a frame configured with corners formed by joining the frame elements with one another, wherein a number of frame elements corresponds to a number of flow guide elements.

5. The static mixer according to claim 1, wherein a guide vane is disposed on each of the frame elements, said guide vane facing toward a center axis of the mixer at a predetermined angle.

6. The static mixer according to claim 5, wherein the guide vanes are disposed to cover a partial region of each of the free fluid passage spaces.

7. The static mixer according to claim 1, wherein the flow guide elements are provided with guide vanes disposed at an angle, in a front region of the center element.

8. The static mixer according to claim 1, wherein front edges of the sections that face one another are disposed to almost touch one another in a region of the frame elements.

9. The static mixer according to claim 1, wherein a lower edge of each of the flow guide elements extends beyond the center element in an axial direction and is configured to have an increasingly greater distance from the a center axis of the mixer.

10. The static mixer according to claim 5, wherein a segment of the mixer consisting of a flow guide element, an inclined section, a frame element, a guide vane and guide element, is formed from a single component that has been bent in multiple ways.

* * * * *